US005317773A

United States Patent [19]

Graebe

[11] Patent Number: 5,317,773

[45] Date of Patent: Jun. 7, 1994

[54] WATERBLOWN FOAM BASE

[76] Inventor: Robert H. Graebe, 7 Persimmon Ridge Dr., Belleville, Ill. 62223

[21] Appl. No.: 975,848

[22] Filed: Nov. 13, 1992

Related U.S. Application Data

[63] Continuation-in-part of Ser. No. 839,305, Feb. 20, 1992, abandoned.

[51] Int. Cl.[5] ..... A47C 7/18; A47C 7/02

[52] U.S. Cl. ..... 5/653; 5/481; 297/452.25; 297/452.26

[58] Field of Search ..... 5/653, 654, 481, 448, 5/464, 468; 297/DIG. 1, 459, 284.1, 452.25, 452.26; D6/596, 601

[56] References Cited

U.S. PATENT DOCUMENTS

| | | | |
|---|---|---|---|
| D. 335,235 | 5/1993 | Hildreth | D6/601 |
| 2,800,165 | 7/1957 | Talalay et al. . | |
| 2,970,638 | 2/1961 | Halter | 297/460 |
| 4,424,599 | 1/1984 | Hannouche . | |
| 4,726,624 | 2/1988 | Jay | 5/654 |
| 5,018,790 | 5/1991 | Jay | 297/284.1 |
| 5,079,790 | 1/1992 | Pouch | 5/464 |
| 5,163,737 | 11/1992 | Navach et al. | 5/481 |

FOREIGN PATENT DOCUMENTS

| | | | |
|---|---|---|---|
| 1030500 | 6/1953 | France | 5/653 |

*Primary Examiner*—Alexander Grosz

*Attorney, Agent, or Firm*—Polster, Lieder, Woodruff & Lucchesi

[57] ABSTRACT

A waterblown urethane foam base having a flat seat portion and a raised front portion with angularly directed valleys and a raised pommel. The area beneath the front portion is made more flexible and reduced in weight and is defined by a series of hollowed out areas separated by ribs which support the top surface of the front portion along with the front and side walls of the front portion.

7 Claims, 2 Drawing Sheets

WATERBLOWN FOAM BASE

RELATED APPLICATIONS

This application is a continuation-in-part of prior co-pending application Ser. No. 07/839,305, now abandoned filed Feb. 20, 1992, entitled MODULAR CUSHION CONSTRUCTION WITH FOAMED BASE.

BACKGROUND OF THE INVENTION

This invention relates in general to cushions for seating, and, more particularly, to a modular wheelchair cushion having a shaped waterblown foam base.

The foamed base of this application is for use with the modular cushion shown in Ser. No. 07/839,305 now abandoned in favor of continuation-in-part application Ser. No. 08/053,551, and the disclosure of Ser. No. 07/839,305 now abandoned is incorporated herein by reference as if Ser. No. 07/839,305 now abandoned were set forth in its entirety herein. The base is adaptable for use with pads with upstanding air cells such as those shown in Graebe U.S. Pat. No. 4,541,136, preinflated cells as shown in Graebe U.S. Pat. No. 5,152,023 and co-pending Graebe design application Ser. No. 29/000,120 filed Oct. 5, 1992, and any of the variations shown in Ser. No. 07/839,305, now abandoned the hollow dome shaped pads shown in Sias, et al. U.S. Pat. Nos. 4,673,305, 4,605,582 and U.S. Pat. No. Des. 294,212 "T-foam", molded domes, or arch elements as shown in Graebe U.S. Pat. No. 4,713,854.

The base of this invention also can be used with the cover shown in Ser. No. 07/839,305 now abandoned or Graebe U.S. Pat. No. 5,111,544.

The base shown and claimed in Ser. No. 07/839,305 now abandoned is fluorocarbon blown and this created a skin on the molded surfaces which gives the base rigidity and firmness combined with its being light in weight because a low density composition can be used. The skin that forms on the outer surface gives stability even to a lightweight low density product.

However, environmental standards now require that no fluorocarbons be used in making foamed plastic parts. Therefore, water based blowing agents must be used. These generate $Co_2$ as the blowing agent which is not as harmful to the environment as the fluorocarbons. Unfortunately, $CO_2$ blown foam does not have an outer skin and therefore is relatively more flexible and less stable than fluorocarbon blown foam of the same density.

It therefore is a primary object of the present invention to provide a waterblown urethane foam cushion base which is relatively light in weight and still has the required rigidity and soft feel to the user.

SUMMARY OF THE INVENTION

The present invention comprises a waterblown urethane cushion base is light in weight and has a soft feel to the user while still retaining resistance to buckling when the useer is seated thereon.

These and other objects and advantages will become apparent hereinafter.

DETAILED DESCRIPTION

Figure 1:
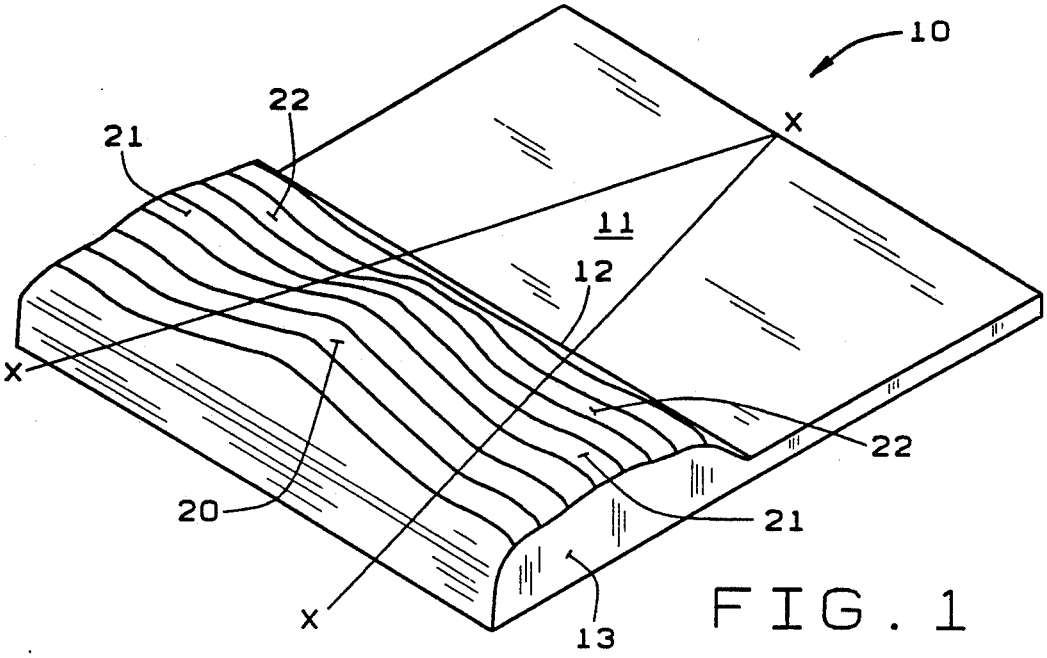
FIG. 1 is a top perspective view of the cushion of this invention.
Figure 2:
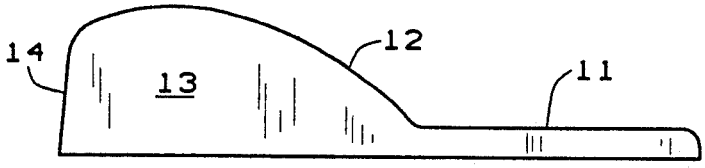
FIG. 2 is a side elevational view.
Figure 3:
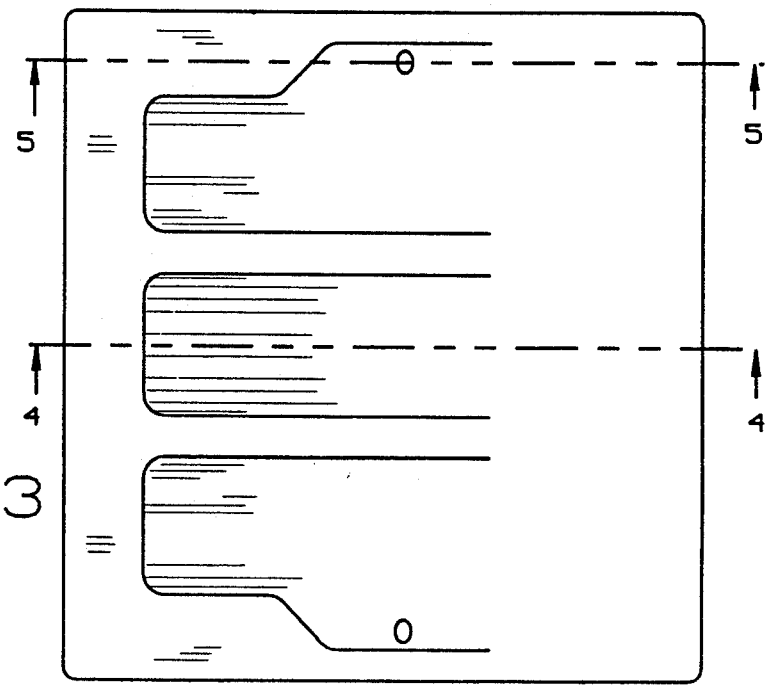
FIG. 3 is a bottom plan view.
Figure 4:
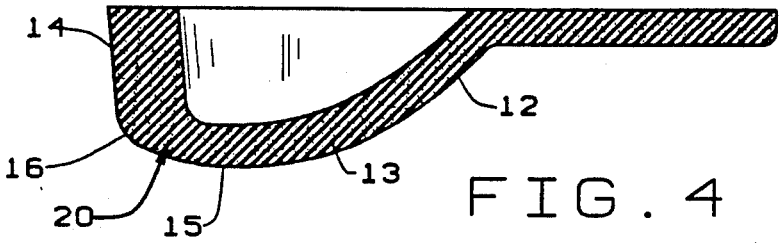
FIG. 4 is a sectional view taken along line 4—4 of FIG. 3.
Figure 5:
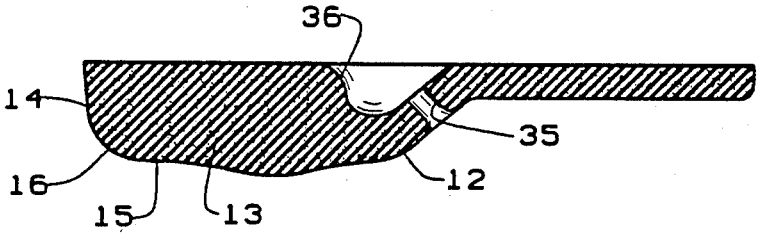
FIG. 5 is a sectional view taken along line 5—5 of FIG. 3.

The shaped molded base 10 is shown in FIGS. 1 and comprises a flat rear area 11 which has substantially the same thickness from side-to-side and front-to-back. The flat rear section 11 is designed to accommodate a resilient pad of the type shown in Graebe U.S. Pat. No. 4,541,136, or any other suitable pad hereinbefore described. A sloped connecting area 12 connects the flat rear area 11 with a raised front area 13. The connecting area 12 is shown in FIGS. 2, 4 and 5 and is designed to force support to the thighs and relieves pressure on the ischia, and the trochanters. It also provides a flat surface which accommodates the genitals of a male user. The base 10 also includes an inwardly inclined front face 14 (FIGS. 2, 4 and 5). The top surface 15 of the front area 13 joins the front face 14 in a curved surface 16 which is designed to prevent damage to the legs of the user.

The front area 13 includes a raised pommel 20 which is higher than curved side or thigh supporting areas 21. Between the pommel 20 and the side areas 21 are dish shaped leg retaining valleys 22 which are angularly inclined outwardly away from the rear base area 11 along the lines X—X in FIG. 1 so as to separate the legs in conjunction with the pommel 20. This outwardly inclination of the legs tends to retain the hip joints in place, especially with atrophied patients. As a patient's body atrophies, either from age or non-use, the muscles and tendons required to keep the hip joint together, tend to waste away, and thus, with those patients most likely to require a wheelchair pad of this type, it is important that the legs be positioned as to urge the thigh bone into the hip socket and restrain the hip joint socket from being dislocated.

The curved thigh supporting areas 21 are sloped inwardly from the outer side edge to provide the proper thigh loading characteristics without causing too much pressure on the thighs. The raised pommel 20 separates the legs, stabilizes the pelvis and helps keep the user from sliding out of his seat.

The base 10 is formed of foamed polyurethane and may have various indent densities based on the needs of the user. However, contrary to the base of Ser. No. 07/839,305, now abandoned it is not formed with a fluorocarbon blowing agent and thus does not have a skin on the outer surface. It is blown with a water based blowing agent and, although it can be washed and sterilized and is resistant to moisture and chemicals, it needs to be more dense to provide the same properties as the fluorocarbon blown urethane.

Figure 6:
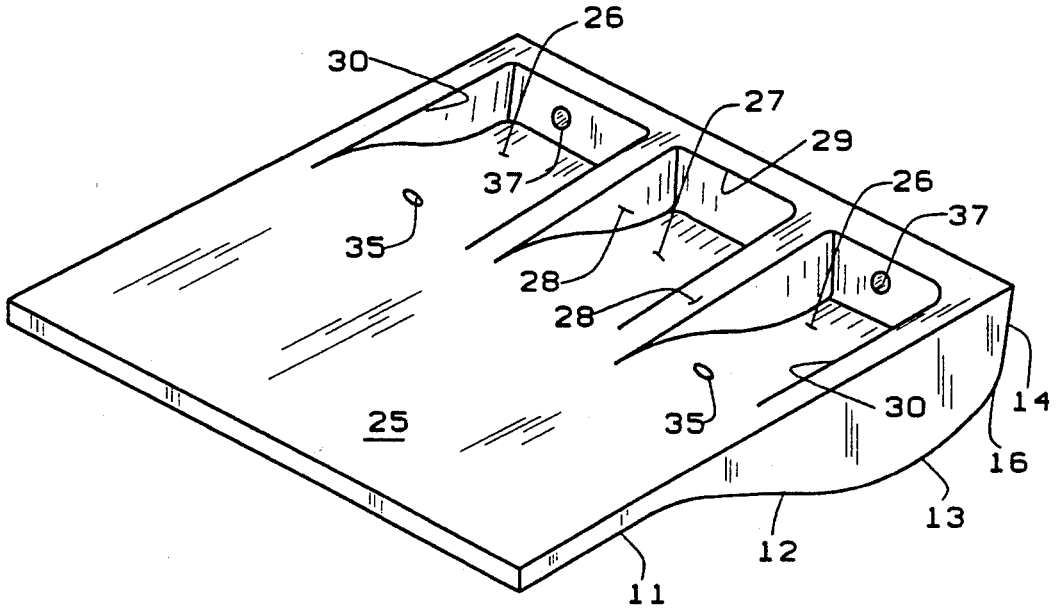
FIG. 6 is a bottom plan view of a modification of this invention.

Thus, the interior structure of the present base 10 is modified to provide the same weight and patient feel characteristics as the fluorocarbon blown urethanes. FIGS. 6 is a perspective view of a slightly modified underside of the base 10. It shows the bottom surface 25, which beneath the front area 13 has hollowed out outer sections 26 and a hollowed out center section 27. The hollowed out center area 27 provides a softer feel for the user as well as providing some relief for the genitals of the male user. It also reduces the weight of the cushion. The side hollowed out areas 26 also provide cushion weight relief and gives a softer feel to the legs of the user. Separating the cavities 26,27 are walls or ribs 28 which provide top to bottom support, and prevent the collapse of the front area 13. A front wall 29 and side walls 30 complete the structure of the base front area 13. The front wall 29 keeps the front edge from buckling from the weight of the user and the side walls 30 do the same for the side edges of the front area 13.

The width of the front wall 29, the side walls 30 and the ribs 28 are relative to the width of the base 10. The widths may vary slightly, but, in general, they are about 1" for 16–18" bases, and about ½" for 8–9" bases. For bases of intermediate widths, the wall thickness varies between about ½" to about 1".

Openings 35 are provided through the sloped connecting area 12 to accommodate inflating nozzles and valves, if an inflatable pad is used on the flat area 11. These may communicate with a hollowed out area 36 in the side walls 30 as shown in FIG. 5, or may communicate with the side cavities 26 as shown in FIG. 6. Access to the front wall 14 may be had through ports 37 therein, if desired. This will allow the user to inflate an inflatable pad while seated on the cushion. The ports 35,37 also allow pressures or temperatures of the patient to be measured from beneath a pad positioned on the flat area 11.

This invention is intended to cover all changes and modifications of the example of the invention herein chosen for purposes of the disclosure which do not constitute departures from the spirit and scope of the invention.

What is claimed is:

1. A shaped base made from expanded foam having (a) top and bottom surfaces, (b) a substantially flat rear portion to accommodate the buttocks of a user, said rear portion having a lateral edge which defines the back edge of the base, (c) a raised front portion having a central pommel to separate the legs and curved depressed areas adjacent to the pommel to accommodate the legs of the user, (d) raised side edges to load the thighs, (e) an angularly inclined stepdown section connecting the flat rear portion and the raised front portion to force support to the thighs and relieve pressure to the ischia and trochanters, and (f) the raised front portion being hollowed out to define front and side walls and provided with intermediate spaced ribs which with the front and side walls support the top surface, (g) the rear portion extending from the back edge of the base to the stepdown section and completely across the base from side-to-side, said rear portion being of substantially uniform thickness throughout.

2. The base of claim 1 wherein the ribs and the front and side walls are substantially the same widths.

3. The base of claim 2 wherein there are two intermediate ribs substantially equally spaced between the side walls to divide the hollowed out area into three substantially equal segments longer than they are wide.

4. The base of claim 1 wherein the depressed leg areas of the front portion are angularly inclined in a diverging direction toward the front of the base.

5. The base of claim 1 wherein the side and front walls and the ribs are about ½" to about 1" in thickness.

6. The base of claim 1 wherein the front wall inclines from the bottom surface inwardly toward the top.

7. The base of claim 1 including a port in the front wall of the hollowed out portion and a second port in top surface of the base to allow access to the top of the base through the hollowed out portion.

* * * * *